US007735275B2

(12) United States Patent
Vandewater, Jr.

(10) Patent No.: US 7,735,275 B2
(45) Date of Patent: Jun. 15, 2010

(54) ELEVATED BATTEN SYSTEM

(75) Inventor: Gerald Charles Vandewater, Jr., Thousand Oaks, CA (US)

(73) Assignees: Boral Lifetile, Inc., Roswell, GA (US); Monier, Inc., Irvine, CA (US)

( * ) Notice: Subject to any disclaimer, the term of this patent is extended or adjusted under 35 U.S.C. 154(b) by 404 days.

(21) Appl. No.: 11/832,406

(22) Filed: Aug. 1, 2007

(65) Prior Publication Data

US 2009/0031670 A1 Feb. 5, 2009

(51) Int. Cl.
*E04D 1/00* (2006.01)

(52) U.S. Cl. ..... 52/302.1; 52/478; 52/551; 52/480; 52/747.1

(58) Field of Classification Search ..... 52/385, 52/384, 553, 551, 475.1, 781.3, 483.1, 482, 52/479, 390, 391, 392, 746.1, 746.11, 403.1, 52/302.1, 478, 480, 733.2, 747.1
See application file for complete search history.

(56) References Cited

U.S. PATENT DOCUMENTS

| | | | | |
|---|---|---|---|---|
| 965,595 | A | 7/1910 | Nicholson | |
| 1,163,034 | A | 12/1915 | Phippen | |
| 2,424,410 | A * | 7/1947 | Miles | 52/537 |
| 2,862,255 | A | 12/1958 | Nelson | |
| 3,253,375 | A | 5/1966 | Takehara | |
| 4,007,571 | A * | 2/1977 | Marchello et al. | 52/483.1 |
| 4,170,859 | A * | 10/1979 | Counihan | 52/779 |
| 4,233,793 | A * | 11/1980 | Omholt | 52/390 |
| 4,958,471 | A | 9/1990 | Waddington | |
| 5,197,252 | A | 3/1993 | Tiscareno | |
| 5,412,917 | A * | 5/1995 | Shelton | 52/403.1 |
| 5,425,908 | A * | 6/1995 | Merser | 264/46.4 |
| 5,471,807 | A | 12/1995 | Vasquez | |
| 5,642,596 | A | 7/1997 | Waddington | |
| 6,189,274 | B1 * | 2/2001 | Ollikainen | 52/264 |
| 6,226,949 | B1 | 5/2001 | Huber | |
| 6,266,937 | B1 * | 7/2001 | Watanabe | 52/489.2 |
| 6,314,700 | B2 * | 11/2001 | Starr | 52/540 |
| 6,357,193 | B1 | 3/2002 | Morris | |
| 6,393,796 | B1 | 5/2002 | Goettl et al. | |
| 6,453,630 | B1 | 9/2002 | Buhrts et al. | |
| 6,536,171 | B1 * | 3/2003 | Vandewater | 52/302.1 |
| 6,718,719 | B1 | 4/2004 | Hagerty | |
| 7,386,962 | B2 * | 6/2008 | Estes et al. | 52/553 |
| 7,559,181 | B2 * | 7/2009 | Estes et al. | 52/741.1 |
| 2003/0233800 | A1 | 12/2003 | Vandewater | |
| 2005/0000172 | A1 | 1/2005 | Anderson | |
| 2006/0150536 | A1 | 7/2006 | Smith | |
| 2007/0256381 | A1 | 11/2007 | Foote, Jr. | |

* cited by examiner

*Primary Examiner*—Richard E Chilcot, Jr.
*Assistant Examiner*—Alp Akbasli
(74) *Attorney, Agent, or Firm*—Alston & Bird, LLP

(57) ABSTRACT

Various embodiments of the invention are directed to an elevated batten system that includes a horizontal batten strip to which cylindrical-shaped pads are coupled. The pads elevate the horizontal batten strip above the roof deck surface, preventing water and debris from gathering on the roof deck surface and eliminating the need to install the vertical and horizontal battens in separate steps. Other various embodiments of the invention are directed to an elevated batten system that includes a horizontal batten strip to which pads are coupled that define a depressed portion. The depressed portion receives a fastener for coupling each pad to the horizontal batten strip, and in some embodiments, prevents irregularities in the height of the horizontal batten strip relative to the roof deck surface when installed on the roof deck surface.

16 Claims, 4 Drawing Sheets

ELEVATED BATTEN SYSTEM

BACKGROUND OF THE INVENTION

Counterbatten systems are used with tile roof installations to elevate the roof tiles above the roof deck surface. By elevating the roof tiles, water is prevented from gathering under and/or around the roof tiles, which protects the roof deck from damage, and the air space created between the roof deck and the roof tiles facilitates ventilation of the roof.

Counterbatten systems are typically created by fastening wood strips, which are called vertical battens, in a vertical direction up the roof at 16" or 24" on center onto the roof decking. Horizontal, or anchor, battens are then fastened directly onto these vertical battens. The size of the batten strips will vary according to spacing and load factors, but the minimum dimensions are typically ⅜" thick for the vertical strips and nominal 1"×3" for the horizontal strips. By installing the horizontal battens onto the vertical battens, nail penetrations into the roof decking are minimized, and the nails that penetrate the roof deck are less likely to be exposed to water because they only penetrate the vertical strips that run parallel to water flow.

Although such counterbatten systems provide some advantages to tile roof installations, they may be time consuming to install. U.S. Pat. No. 6,536,171 discloses an elevated batten system solution in which pads or blocks are attached to the underside of the horizontal batten strips prior to installation, and these pads serve the function of the vertical strips of the counterbatten system. By not having to install the vertical strips, the installation may progress more quickly and with less materials. This elevated batten system uses diamond-shaped pads, which diverts the flow of any water to either side of the pad. Such systems require relatively accurate orientation and attachment of the pads relative to the strips, which can increase the amount of time and cost it takes to manufacture the batten strips. In addition, inconsistencies in the height of the batten strips at each pad may be introduced when the pads are attached to the horizontal strips if a fastener, such as a nail or staple, is not inserted into the pad properly or if varying amounts of adhesive are used to couple the pads to the horizontal strips.

Thus, there remains a need in the art for an improved elevated batten system.

SUMMARY OF THE INVENTION

Various embodiments of the invention provide an improved elevated batten assembly for use atop an inclined roof supporting surface and for supporting tiles above the inclined roof supporting surface. The elevated batten assembly comprises (1) an elongate horizontal batten strip that has an underside for generally facing the inclined roof supporting surface and (2) a plurality of support pads that are spaced apart and coupled to the underside of the batten strip. The support pads each include opposing first and second sides, wherein each of the first and second sides comprises a substantially flat surface. The first side is coupled adjacent to and substantially in planar contact with the underside of the batten strip. In addition, the second side of each support pad is configured for being substantially in planar contact with the inclined roof supporting surface, the support pads support the batten strip above the inclined roof supporting surface, and each of the support pads have a cylindrical wall that extends between the first and second sides. According to one embodiment of the invention, the cylindrical-shaped pads do not require orientation relative to the horizontal batten, which may be required when using square or rectangular shaped pads. In addition, the cylindrical wall of the pads deflects water around the pads to prevent pooling, and the first and second sides of the pads allow the pads to fit substantially flush against the underside of the horizontal battens and the roof deck surface, which prevents debris and other materials from getting caught between the pads and the batten and/or the roof deck and prevents damming that can result in roof leaks or premature deterioration of the underlayment, battens, and/or fasteners.

According to other various embodiments of the invention, an elevated batten assembly for use atop an inclined roof supporting surface and for supporting tiles above the inclined roof supporting surface is provided. The elevated batten assembly comprises (1) an elongate horizontal batten strip that has an underside for generally facing the inclined roof supporting surface and (2) a plurality of support pads that are spaced apart and coupled to the underside of the batten strip. The support pads each include opposing first and second substantially flat side portions, and the first substantially flat side portion of each support pad is coupled adjacent to and substantially in planar contact with the underside of said batten strip. The second substantially flat side portion of each support pad is configured for being substantially in planar contact with the inclined roof supporting surface. In addition, the support pads support the batten strip above the inclined roof supporting surface, and each of the second substantially flat side portions defines a depressed portion that is configured for receiving a fastener for coupling the support pad to the horizontal batten strip. According to one embodiment, installing the fastener in the depressed portion can prevent inconsistencies in the height of the horizontal batten along the length of the batten due to an improperly attached fastener.

DETAILED DESCRIPTION OF THE INVENTION

The elevated batten system according to various embodiments of the present invention is designed to eliminate the need to install the vertical and horizontal battens in separate steps. In particular, pads 14 are attached to the underside of the horizontal battens 12 at the lumber mill or other assembly facility. These pads serve the function of spacing the horizontal batten strips above the roof deck surface, which was served by the the vertical strips used in the prior art counterbatten system described above, but the pads provide a more efficient method of installation and reduce the amount of materials used during installation.

According to various embodiments of the invention, the pads may be cylindrical-shaped or rectangular or square-shaped and made from wood (e.g., plywood) or another suitable material such as rubber, plastic (e.g., HDPE) or other polymer, and/or recycled materials. The pads are attached at pre-defined increments along horizontal batten strips with a suitable fastener (e.g., staples, adhesive, or nails) prior to bundling and shipping from the assembly facility. The pre-defined increments and the dimensions of the pads and the horizontal strips may depend on the load conditions and/or weather conditions to which the roof will be subject. The elevated batten system according to various aspects of the invention may then be installed horizontally along a roof such that the pads are disposed immediately adjacent the roof deck surface or underlayment. In addition, the pre-assembled elevated batten system can be used with any profile of roof tiles and in a variety of load conditions, according to various embodiments. Furthermore, in a particular embodiment, the battens may be treated with pressure treating or other weather resistant properties as needed.

In a particular embodiment, the pads 14 are cylindrical and have a diameter of about 1½" and a thickness of about ⅜". The pads are installed on one side of the horizontal batten 12 at 12" intervals using a staple or other suitable fastener. The pads elevate the horizontal batten above the roof deck by a height substantially equal to the thickness of the pads 14 and provide adequate support for the horizontal batten 12 to prevent deflection.

Figure 3:
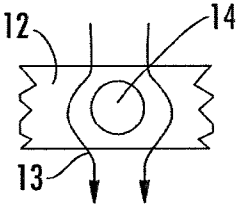
FIG. 3 is schematic diagram of the flow of water 13 around an exemplary pad, according to various embodiments of the invention.

Elevating the battens 12 allows for water and debris to pass freely beneath the battens and allows improved airflow above the roof support surface, which reduces heat gain in the roof system and reduces cooling costs. In addition, unlike rectangular or square-shaped pads, which may require orientation into a diamond-shape relative to the horizontal axis of the horizontal batten prior to attachment to the horizontal batten, cylindrical-shaped pads do not require orientation relative to the horizontal batten. Furthermore, the cylindrical walls of the pads deflect water around the pads to prevent pooling, and the flat sides of the pads allow the pads to fit substantially flush against the underside of the horizontal battens and the roof deck surface, which prevents debris and other materials from getting caught between the pads and the batten and/or the roof deck and prevents damming that can result in roof leaks or premature deterioration of the underlayment, battens, and/or fasteners. For example, as shown in FIG. 3, water and/or debris 13 flow around the pad 14.

In other various embodiments, the pads 14 have rectangular, square, or other polygonal shapes, have thicknesses greater than or less than ⅜" depending on the height requirements of the installation, and may be installed at alternative selected intervals (e.g., 16 inches on center, 24 inches on center, or other selected distances).

Figure 2A:
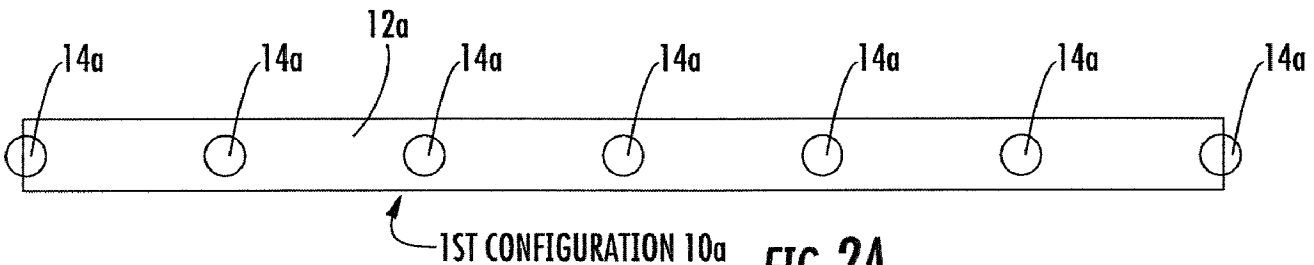
FIG. 2A is a lower plan view of the elevated batten assembly 10 assembled according to a first configuration, according to various embodiments of the invention.
Figure 2B:
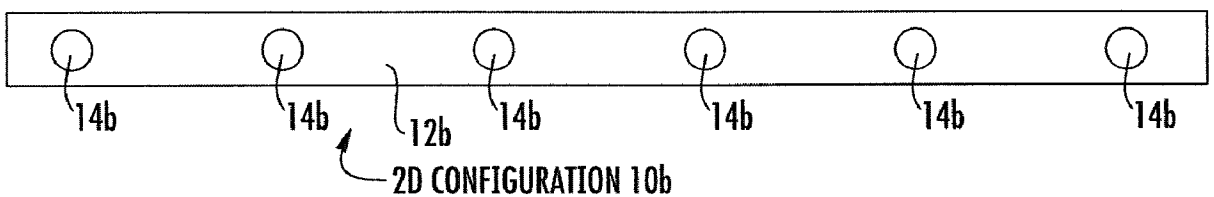
FIG. 2B is a lower plan view of the elevated batten assembly 10 assembled according to a second configuration, according to various embodiments of the invention.
Figure 6:
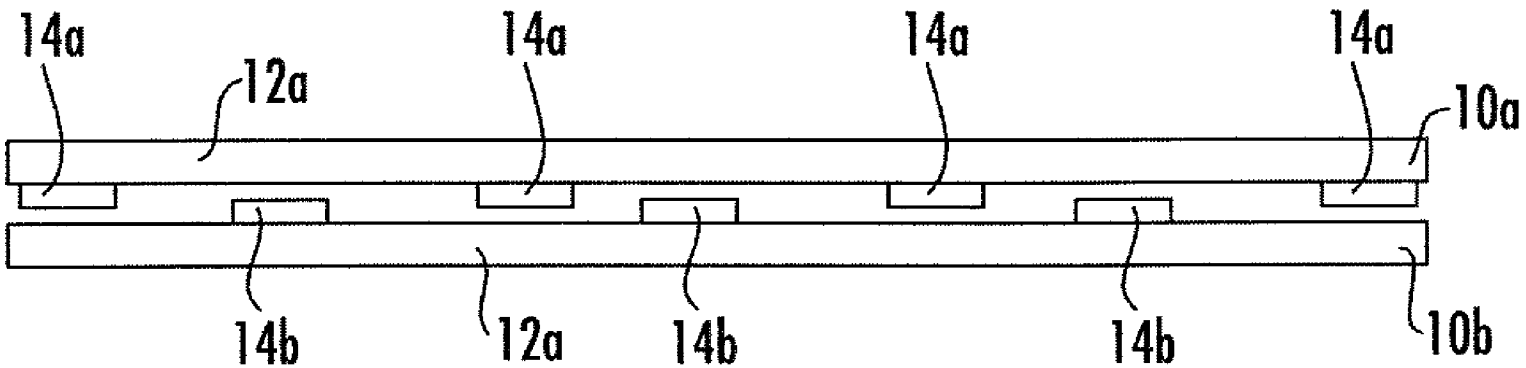
FIG. 6 shows two configurations of batten assemblies 10*a*, 10*b* stacked relative to each other such that the pads of the two batten assemblies have nest between each other in an alternating fashion, according to various embodiments of the invention.

According to a particular embodiment of the invention which is shown in FIGS. 2A and 2B, the pads 14 are spaced from the ends of the horizontal battens in at least two configurations. A first configuration 10*a* is shown in FIG. 10A and a second configuration 10*b* is shown in FIG. 10B. The pads 14*a* in the first configuration 10*a* are positioned closer to the end of the horizontal batten 12*a* than the pads 14*b* in the corresponding second configuration 10*b*. The pads 14*b* in the second configuration 10*b* are spaced from the end of the horizontal batten 12*b* such that a pair of battens 10*a*, 10*b* may be stacked with their respective pad sides cofacing, with the pads nesting between each other in an alternating fashion, such as shown in the embodiment in FIG. 6. In addition, this alternating configuration provides for more efficient stacking and shipping and provides solid support at each end of adjoining battens. The batten assemblies 10*a*, 10*b* can be aligned and bundled with plastic strapping.

Figure 7A:
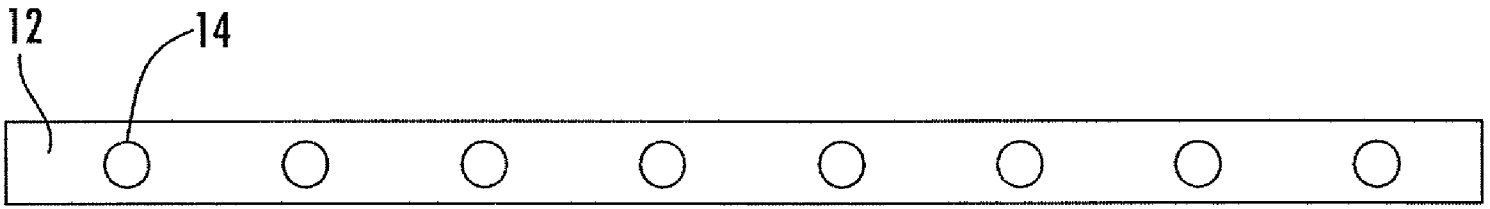
FIG. 7A is a lower plan view of an assembled elevated batten assembly according to an alternative embodiment of the invention.
Figure 7B:
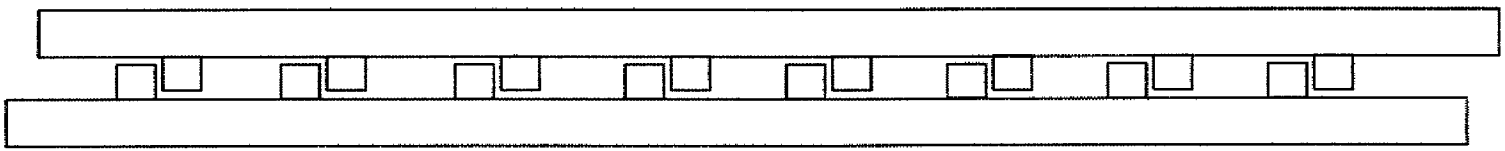
FIG. 7B is a perspective view of two of the assembled elevated batten assemblies shown in FIG. 7A stacked together according to an embodiment of the invention.

In an alternative embodiment, which is shown in FIGS. 7A and 7B, the pads are spaced from the ends of the battens to minimize the risk of splitting during the attachment to the roof. In a particular embodiment, the pads are positioned about three inches from each end of the batten, and when stacked, as shown in FIG. 7B, the ends of the battens are slightly staggered with respect to the each other.

The horizontal batten strips 12 are manufactured from wood, according to various embodiments of the invention. In a particular embodiment, the wood used for the strips 12 is Douglas Fir lumber, which is a strong, construction-grade material. Furthermore, the horizontal strips may be nominal about 1"×about 3" or about 1"×about 2" lumber and cut into about 4 foot or about 8 foot strips, according to various embodiments. The thickness of the lumber may be between about ⅜" and about 1" (e.g., about ¾") and the height of the lumber may be between about 1" and about 3" (e.g., about 1½" or about 2½"), according to various embodiments of the invention.

In addition, in a particular embodiment, twenty four 4 foot strips that are assembled with the support pads are bundled together and strapped, and each bundle provides a sufficient number of battens for installing approximately one square (100 square feet) of roofing tile. In another embodiment, twelve 8 foot strips assembled with support pads are bundled together and strapped, and each bundle provides a sufficient number of battens for installing approximately one square (100 square feet) of roofing tile. Furthermore, according to various embodiments, the strips 12 may be marked on the side of each strip 12 opposite the side to which the pads 14 are attached with to indicate nailing points, making installation easier for the roof system installers.

Figure 1:
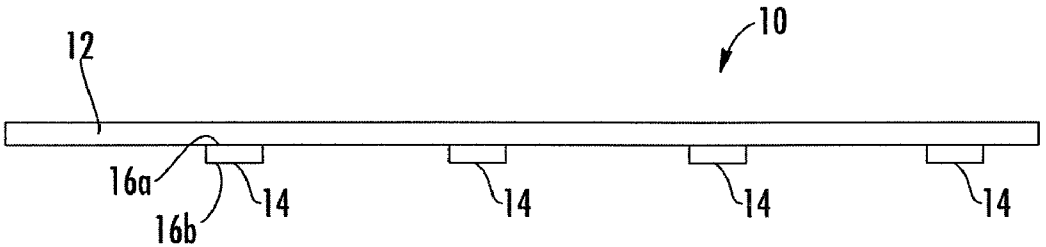
FIG. 1 is a side elevational view of an elevated batten assembly 10 according to various embodiments of the invention.
Figure 4B:
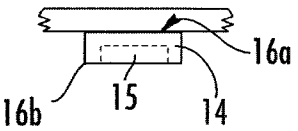
FIG. 4B is a side elevational view of the support pad shown in FIG. 4A.
Figure 4A:
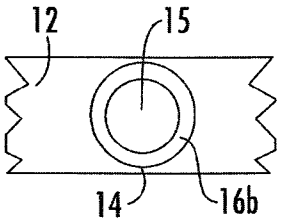
FIG. 4A is a lower plan view of a support pad having a depressed portion according to various embodiments of the invention.

In other various embodiments such as those embodiments shown in FIGS. 1, 4A, and 4B, the pads 14 comprise two substantially flat sides that are opposite each other. The first substantially flat side 16*a* is installed adjacent the horizontal batten 12, and the second substantially flat side 16*b* is installed adjacent the roof deck surface.

In a particular embodiment which is shown in FIGS. 4A and 4B, a depressed portion 15 is further defined in at least one of the first and/or second substantially flat sides 16*a*, 16*b*. According to one embodiment, the depressed portion 15 is defined in the second substantially flat side 16*b* and a fastener, such as a staple, nail, or screw, is engaged into the depressed portion 15 to attach the pad 14 to the horizontal batten 12. The depth of the depressed portion 15 is dimensioned such that the head of the fastener when attached to the pad 14 and the horizontal batten 12 does not extend past the plane in which the substantially flat side 16*a*, 16*b* lies (e.g., the depth of the depressed portion 15 is at least as deep as the thickness of the head of the fastener and may further include some additional tolerance to provide for variations in manufacture of the fasteners, according to one embodiment), and the width of the depressed portion 15 is at least as wide as the width of the head of the fastener.

Figure 5:
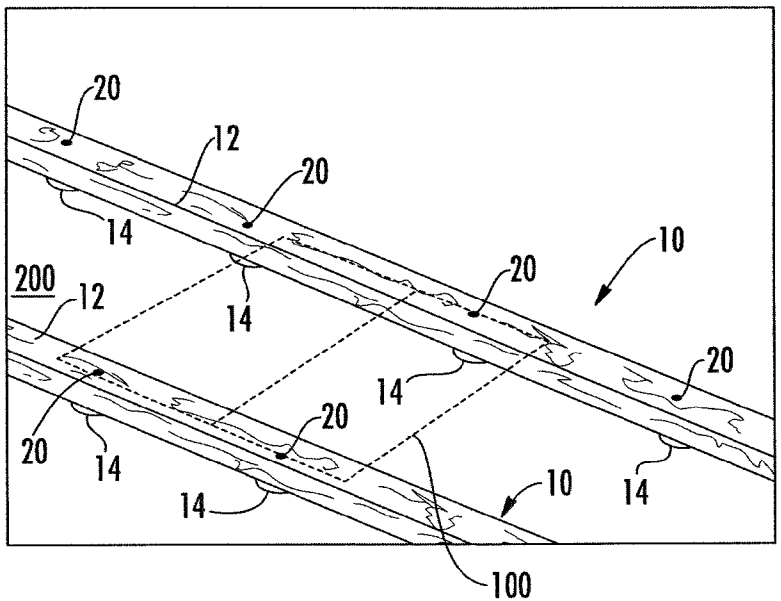
FIG. 5 is a pictorial view showing the outline of an exemplary group of tiles 100 installed atop the elevated batten assembly 10 according to various embodiments of the invention.

Installing the fastener in the depressed portion 15 prevents inconsistencies in the height of the horizontal batten 12 along the length of the batten 12 due to an improperly attached (e.g., protruding) fastener, for example. In addition, according to various embodiments such as the embodiment shown in FIG. 5, the horizontal battens 12 are secured to the roof deck surface 200 using fasteners that are installed into the surface of the battens 12 opposite the underside to which the pads 14 are attached.

By installing the fasteners 20 through the batten 12 and the pad 14, according to one embodiment, a hole in the roof deck surface 200 made by the fastener is protected from water and debris by the edges of the pads' 14 substantially flat sides 16*b*. In addition, the depressed portion 15 allows for flush and non-flush type fasteners to be used to secure the pads 14 to the battens 12. Upon installing the batten assemblies 10 to the roof deck surface 200, tiles 100 may be installed over the batten in a conventional manner on the upwardly facing side of the battens.

CONCLUSION

Although this invention has been described in specific detail with reference to the disclosed embodiments, it will be understood that many variations and modifications may be effected within the spirit and scope of the invention as described in the appended claims.

The invention claimed is:

1. An elevated batten assembly for use atop an inclined roof supporting surface and for supporting tiles above said inclined roof supporting surface, said elevated batten assembly comprising:

an elongate horizontal batten strip having an underside for generally facing said inclined roof supporting surface; and a plurality of support pads spaced apart and coupled to the underside of said batten strip, said support pads each including opposing first and second sides, and each of said first and second sides comprising a substantially flat surface, said first side being coupled adjacent to and substantially in planar contact with said underside of said batten strip, wherein:

said second side of each support pad is configured for being substantially in planar contact with said inclined roof supporting surface, said support pads support said batten strip above said inclined roof supporting surface;

each of said support pads have a cylindrical wall extending between said first and second sides; and at least one of said first and second sides comprises a depressed portion.

2. The elevated batten assembly of claim 1 wherein each of said substantially flat surfaces lies in a flat surface portion plane and said cylindrical wall is defined by a cylindrical axis that is substantially normal to said flat surface portion planes.

3. The elevated batten assembly of claim 1 wherein each of said substantially flat surfaces lies in a flat surface portion plane and said depressed portion is disposed about an axis that extends substantially normal to said flat surface portion planes.

4. The elevated batten assembly of claim 1, wherein said support pads have a nominal thickness.

5. The elevated batten assembly of claim 1, wherein said support pads are attached to said batten strip by a fastener.

6. The elevated batten assembly of claim 1, wherein said support pads are attached to said batten strip by adhesive.

7. The elevated batten assembly of claim 6 wherein said support pads are spaced apart and coupled along the length of each of a pair of said horizontal batten strips in a nonsymmetrical manner such that said pair of batten strips, prior to installation, are configured to nest together, wherein said undersides of said horizontal batten strips face each other and a first end of each of said horizontal batten strips are inverted relative to each other.

8. The elevated batten assembly of claim 1 wherein said support pads are spaced apart and coupled along the length of each of a pair of said horizontal batten strips in a substantially symmetrical manner such that said pair of batten strips, prior to installation, are configured to nest together, wherein said undersides of said horizontal batten strips face each other and each end of each of said horizontal batten strips are staggered relative to each other.

9. An elevated batten assembly for use atop an inclined roof supporting surface and for supporting tiles above said inclined roof supporting surface, said elevated batten assembly comprising:

an elongate horizontal batten strip having an underside for generally facing said inclined roof supporting surface; and a plurality of support pads spaced apart and coupled to the underside of said batten strip, said support pads each including opposing first and second substantially fiat side portions, said first substantially fiat side portion of each support pad being coupled adjacent to and substantially in planar contact with said underside of said batten strip, wherein:

said second substantially flat side portion of each support pad is configured for being substantially in planar contact with said inclined roof supporting surface, said support pads support said batten strip above said inclined roof supporting surface, and each of said second substantially flat side portions defines a depressed portion, said depressed portion configured for receiving a fastener for coupling said support pad to said horizontal batten strip.

10. The elevated batten assembly of claim 9 wherein said fastener comprises a staple.

11. The elevated batten assembly of claim 10 wherein said depressed portion has a width that is at least as wide as said staple used to couple said pad to said horizontal batten strip and a depth at least as thick as a head of said staple.

12. The elevated batten assembly of claim 9 wherein said fastener comprises a nail.

13. The elevated batten assembly of claim 12 wherein said depressed portion has a width that is at least as wide as a head of said nail used to couple said pad to said horizontal batten strip and a depth at least as thick as said head of said nail.

14. The elevated batten assembly of claim 9 wherein each of said support pads has a cylindrical wall extending between said first and second substantially flat side portions.

15. The elevated batten assembly of claim 9 wherein said depressed portion is circular shaped.

16. The elevated batten assembly of claim 9 wherein said depressed portion is rectangular shaped.

* * * * *

UNITED STATES PATENT AND TRADEMARK OFFICE

CERTIFICATE OF CORRECTION

PATENT NO. : 7,735,275 B2
APPLICATION NO. : 11/832406
DATED : June 15, 2010
INVENTOR(S) : Vandewater, Jr.

It is certified that error appears in the above-identified patent and that said Letters Patent is hereby corrected as shown below:

Column 6

Line 30, “fiat” should read --flat--

Line 31, “fiat” should read --flat--

Signed and Sealed this
Twenty-first Day of February, 2012

David J. Kappos

David J. Kappos
*Director of the United States Patent and Trademark Office*